United States Patent [19]

Fisher, Jr.

[11] 4,193,450

[45] Mar. 18, 1980

[54] SURFACE CONTROLLED SUBSURFACE SAFETY VALVE

[75] Inventor: Ernest P. Fisher, Jr., Carrollton, Tex.

[73] Assignee: Otis Engineering Corporation, Dallas, Tex.

[21] Appl. No.: 960,168

[22] Filed: Nov. 13, 1978

[51] Int. Cl.[2] ..... E21B 43/12

[52] U.S. Cl. ..... 166/155; 166/322; 166/324

[58] Field of Search ..... 166/155, 189, 191, 324; 251/63.6; 137/629

[56] References Cited

U.S. PATENT DOCUMENTS

| | | | |
|---|---|---|---|
| 3,854,502 | 12/1974 | Mott | 137/629 |
| 3,860,066 | 1/1975 | Pearce et al. | 166/324 X |
| 4,074,761 | 2/1978 | Mott | 166/324 X |
| 4,105,075 | 8/1978 | Helmus | 166/324 X |
| 4,119,147 | 10/1978 | Arendt et al. | 166/155 |
| 4,140,153 | 2/1979 | Deaton | 166/324 X |
| 4,149,698 | 4/1979 | Deaton | 251/63.6 |

*Primary Examiner*—Ernest R. Purser
*Attorney, Agent, or Firm*—Vinson & Elkins

[57] ABSTRACT

Disclosed is a surface controlled subsurface safety valve adapted to be landed in a dual line landing nipple. The safety valve is used to control well fluids conducted through the bore of a well tubing string. The valve has a control fluid pressure chamber and a balance pressure chamber along with a zone in the valve exposed to balance fluid pressure. The control fluid pressure chamber is interspersed between the balance fluid pressure chamber and the balance pressure zone, and has a system of seals associated therewith, that provide a fail-closed safety system. Tubing bore pressure, in the event of seal failure, enters the balance pressure chamber, causing the safety valve to close. This abstract of the disclosure is neither intended to define the scope of the invention which, of course, is measured by the claims nor is it intended to limit the invention in any way.

10 Claims, 3 Drawing Figures

SURFACE CONTROLLED SUBSURFACE SAFETY VALVE

BACKGROUND OF THE INVENTION

1. Field of the Invention

The invention relates to an improved well safety valve for use in controlling well fluids conducted through the well tubing bore. More particularly, the safety valve possesses a fail-closed system for dual pressure fluid operation.

2. The Prior Art

Surface controlled subsurface safety valves have been used to control flow in a well at a subsurface location for some time. It is well known to provide a well safety valve to control the fluid flow in a well conduit by means of a valve which is movable between an open and closed position and in which means are provided to move the valve toward the closed position and control pressure acts to move the valve toward an open position. If the means for moving the valve to the closed position includes a pressurized chamber, the pressure in the pressurized chamber is normally enclosed by seals. Usually, in such subsurface safety valves a spring or other resilient urging means is used to move the valve to the closed position. The balance fluid pressure is used to overcome the hydrostatic pressure present in the column of hydraulic fluid which operates the means responsive to the control fluid pressure in opening the safety valve.

The entry ports through which control and balance fluid enters the landing nipple housing the safety valve are positioned in such a manner that they are essentially isolated one from the other and each pressure zone must withstand tubing bore pressure by operation of seals surrounding such entry ports for the pressure chambers. Thus, in the event of seal failure in the area of the control pressure chamber tubing bore pressure would probably enter the control pressure chamber causing the valve to fail in the open position. Such occurrence would undoubtedly cause a dangerous situation since there would be no safety valve system then closable to prevent escape of tubing pressure or fluids to the surface of the well.

Consequently, there has been a search to develop a surface controlled subsurface safety valve having a seal arrangement that would provide a fail-closed safety system.

SUMMARY OF THE INVENTION

The above fail-closed system is provided in the present invention which is directed to a surface controlled subsurface safety valve comprising a housing means for defining a flow path, closure means for controlling flow through said flow path, operator means longitudinally movable with respect to said housing means for moving said closure means and having a first position wherein said closure means closes said flow path and having a second position wherein said closure means opens said flow path, control fluid pressure responsive means for moving said operator means from said first position to said second position when effected by fluid pressurized at least to a selected value, balance fluid pressure responsive means for pressure balancing said operator means with respect to hydrostatic fluid pressure, resilient urging means for urging said operator means longitudinally within said housing means to move said closure means to its first position, a control fluid pressure chamber associated with said control fluid pressure responsive means for receiving control fluid, a balance fluid pressure chamber associated with said balance fluid pressure responsive means for receiving balance fluid, the balance fluid pressure chamber being interposed between said control fluid pressure chamber and well bore pressure and a balance fluid zone exposed to balance fluid, said balance fluid zone being interposed between said control fluid pressure chamber and well bore pressure.

It is an object of the present invention to provide a surface controlled subsurface safety valve having a fail-closed safety system.

It is another object of the invention to provide a surface controlled subsurface safety valve utilizing control pressure and balance pressure wherein the control chamber is shielded from tubing bore pressure by the balance pressure in a balance pressure zone surrounding the control pressure.

Another object of the invention is to provide a subsurface safety valve having closure means therein operable by control and balance fluid pressure and where the control pressure chamber of such valve is protected from tubing bore pressure by having balance fluid pressure zones interposed between the control pressure chamber and tubing bore pressure, providing a fail-closed subsurface safety valve.

Another object of the invention is to provide a subsurface safety valve as described in the above objects and where such subsurface safety valve is adapted to be used in pump down operations.

It is yet another object of the invention to provide a surface controlled subsurface safety valve as described in the above objects and wherein such subsurface safety valve is adapted to be used in wire line operations.

BRIEF DESCRIPTION OF THE DRAWINGS

These and other objects, advantages and features of the present invention will become more apparent upon consideration of the following specification, taken in connection with the accompanying drawing, wherein.

DESCRIPTION OF THE PREFERRED EMBODIMENTS

Figure 1:
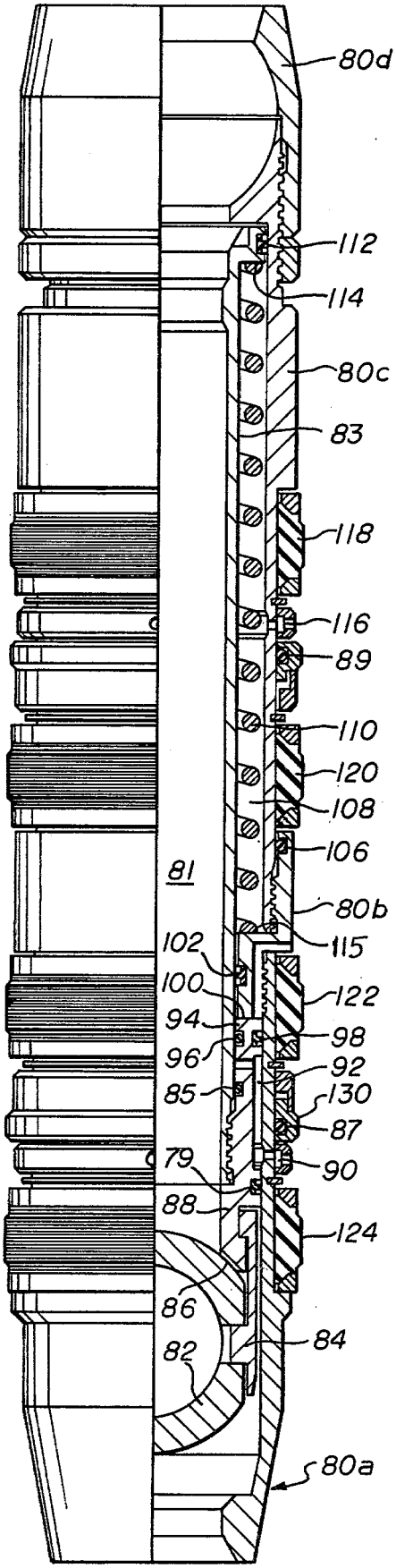
FIG. 1 is an elevational drawing, partly in cross-section, illustrating one embodiment of the present invention consisting of a surface controlled subsurface safety valve.
Figure 2A:
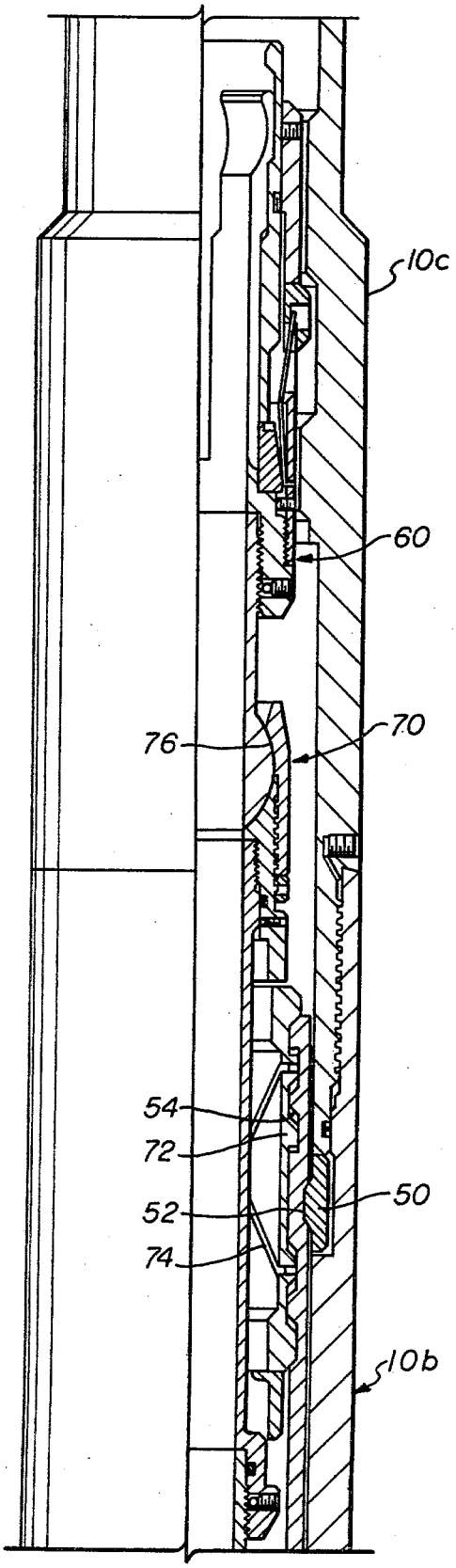
FIGS. 2A and B are elevational views, partly in cross-section, illustrating a landing nipple which is adapted to be made up in a tubing string having landed therein the surface controlled subsurface safety valve of the present invention.
Figure 2B:
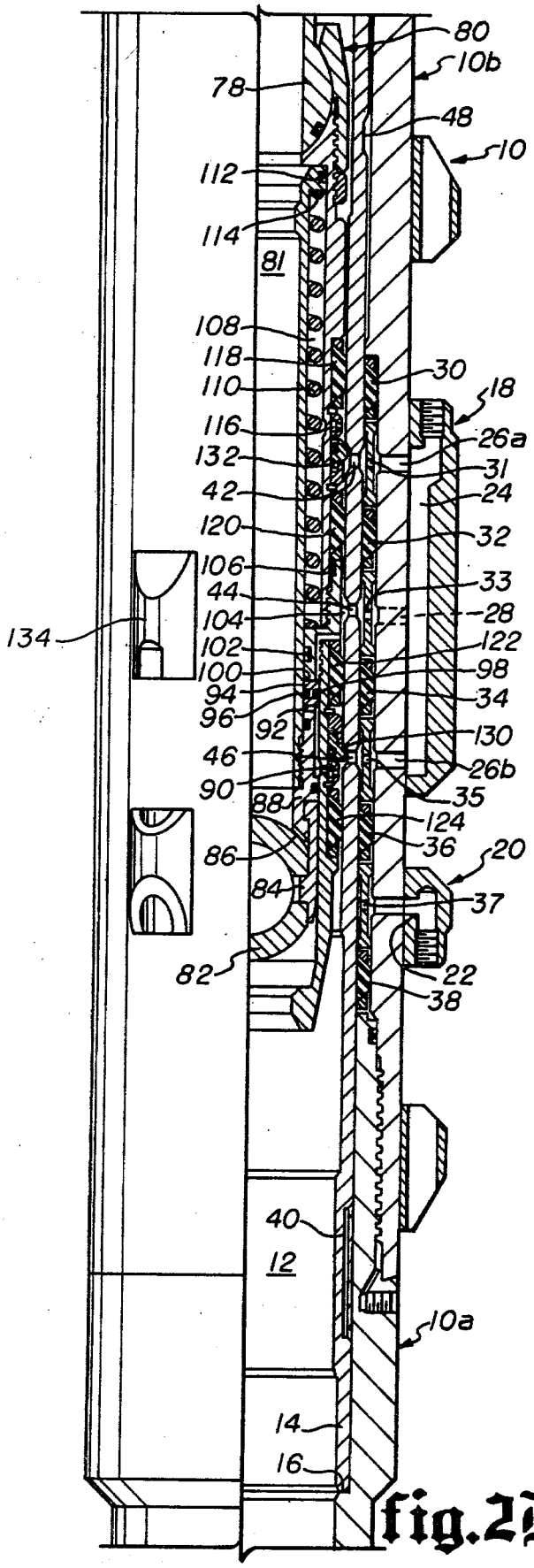

While the drawings accompanying the present application illustrate a pump down or through-the-flow-line (TFL) safety valve the invention is equally applicable to a wire line set and retrievable safety valve. The safety valve of the present invention, illustrated in FIGS. 1 and 2A–B, is characterized by having a tubular housing 80 for defining a flow path through the bore 81 thereof. The valve closure means 82 for controlling flow through the bore 81, as illustrated in FIG. 1, is a ball rotatable between a bore closed position and a full bore open position. The ball 82 as illustrated is in the bore closed position. In the closed position, the ball 82 is seated upon a seat 86 which forms the lower end of an operator 83 which is longitudinally movable with respect to housing 80 for moving the closure member 82. The operator 83 has a first position wherein the closure member 82 closes the flow path through the bore 81 and has a second position where closure member 82 opens the flow path through bore 81.

The ball closure member 82 is rotatable about pin 84 in the manner that is well known in the art. Typical of the art relating to ball safety valves and mechanism for operating a ball closure member, such as used in the present invention, is U.S. Pat. No. 3,703,193 issued to George M. Raulins and assigned to Otis Engineering Corporation. The ball operation is also discussed in U.S. application Ser. No. 794,410, filed May 6, 1977, by Thomas M. Deaton and assigned to Otis Engineering Corporation, now U.S. Pat. No. 4,140,153.

The operator tube 83 is responsive to control fluid pressure, which moves the operator tube to a second position wherein the ball closure member 82 is rotated to the full bore open position. Control fluid is conducted first to the landing nipple, as illustrated in FIG. 2, through entry ports in the landing nipple and then into a zone 104 which has access to a control fluid pressure chamber 100 in the safety valve. The zone for receiving control fluid 104 is the annular space between the outside of the safety valve and the inside bore wall of the landing nipple.

A balance fluid pressure chamber is positioned in the annular space between the operator tube 83 and the tubular housing member 80. Control pressure chamber 100 is isolated from the balance fluid pressure chamber in the valve by a seal member 102 on the inside diameter of the tubular housing **80*b* of the safety valve. The seal member 102, as illustrated in FIG. 1, is known as a "T" seal, and seals between the operator tube 83 and the housing member 80*b***.

The balance pressure chamber 108 receives balance fluid from a source remote from the landing nipple in which the safety valve is housed. Balance fluid is conducted from a source at the surface of the well to the landing nipple and enters the balance fluid pressure chamber 108 via a passageway **26*a*, entry port 31 of the nipple, port 42 in the sliding sleeve 14 of the landing nipple, and then into an annular balance fluid zone existing between the safety valve and the bore wall of the landing nipple. Balance fluid would enter the safety valve through port means 116 on tubular subassembly 80*c* and enter the balance pressure chamber 108. Balance fluid would then be confined within the pressure chamber 108 by a T-seal 112, positioned on the upper end of the operator tube 83, sealing between the operator tube 83 and the inside surface of tubular housing member 80*c*. An upper shoulder 114 of the operator tube 83 is responsive to balance fluid in the balance fluid pressure chamber 108, for assisting in closing ball member 82**.

Balance fluid equalizes the effects of the hydrostatic pressure that exists due to the column of hydraulic fluid in control fluid conduit to the safety valve. Therefore, the balance pressure chamber, in equalizing the hydrostatic column of fluid to the surface of the well permits an urging means 110 to close the ball member 82. The urging means 110, in the present invention, is a helical spring disposed within the annular space 108 between the outside of the operator tube 83 and the inside of the housing member 80. The upper end of the spring 110 is engaged with a shoulder 114 of the operator 83. The lower end of the spring engages shoulder 115 of the housing **80*b*. The entry port 116 for admitting balance fluid into the valve is protected from exposure to well bore pressure by seals 118 and 120 which are positioned on either side of entry port 116 on the housing member 80*c*. An O-ring 106 in sealing contact between the junction of housing member 80*b* and 80*c* prevents balance fluid from entering the control fluid zone existing between seals 120 and 122**, which seal the zone for control fluid when the safety valve is positioned in the landing nipple.

An additional zone within the valve is exposed to balance fluid pressure. This zone 92 is positioned between the control pressure chamber 100 and well bore pressure in order to provide additional protection against well bore pressure entering the control pressure chamber 100. The surface area of the balance fluid pressure exposed zone 92 is equal to the seal effective area of the control pressure chamber 100.

By seal effective is meant the surface area exposed to either control fluid pressure or balance fluid pressure within their respective zones as defined by means for sealing between the zones. The balance fluid pressure zone 92 is defined by seals 85, 96, 79 and 98 which seal against entry of tubing bore pressure or co-mingling of balance and control fluids as hereinafter described.

The O-ring 85 provides sealing between operator tube 83 and operator-seat member 88, while O-ring 96 provides a sealing relation between operator tube member 83 and extended portion 94 of the operator-seat member 88. O-ring 96 provides a seal between the balance fluid exposed zone 92 and the control fluid pressure chamber 100. In like manner, a T-seal member 98 provides a sealing protection between balance fluid and control fluid.

Balance fluid is supplied to the balance fluid exposed zone 92 in the following manner. Balance fluid from the landing nipple balance conduit 24 traverses passageway **26*b*, entry port 35 in the landing nipple and then progresses through port 46 in the sliding sleeve 14 and furnishes balance fluid to an annular space between the safety valve and the landing nipple. Balance fluid is retained in this annular space by seals 122 and 124 of the safety valve which engage the walls of the nipple bore to provide a sealing relationship therebetween. Balance fluid then enters balance fluid exposed zone 92 through a port 90**.

In the event seal 124 fails, tubing bore pressure escaping between the safety valve and the sleeve 14 would enter the annular space between seals 122 and 124 and progress through port 46, port 35, passageway **26*b* of the landing nipple and traverse passageway 24 and would invade the balance pressure chamber 108. Since tubing bore pressure plus pressure due to resilient means 110 normally exceeds the pressure being applied by control fluid in control fluid chamber 100, this would cause the operator tube 83 to be forced upwardly, which in turn would cause the safety valve ball member 82 to respond to the upward movement of operator tube 83 closing the safety valve. In a like manner the failure of seal 112, 118, 79, or 85 would close the safety valve. Should seal 120, 122, 102, 96, or 98 fail, the pressure in control fluid chamber 100 and balance pressure chamber 108 would equalize, allowing resilient means 110 to move operator tube 83 upwardly, causing ballmember 83** to close. It is this sequence of events that causes the present safety valve to be considered fail-closed in its mode of operation.

The balance fluid exposed zone 92 has a fixed capacity while balance fluid pressure chamber 108 has a variable capacity as does the control pressure chamber 100. Applying manifold pressure at the surface of the well to the control fluid conduit to the safety valve causes an expansion of the variable capacity control pressure chamber 100 which causes the operator tube 83 to be forced downwardly rotating ball member 82 to the full bore open position.

In the embodiment illustrated in FIGS. 2A and 2B, the safety valve useful for pump down operations would normally carry wear rings 130 which are positioned on the outside of the safety valve housing member 80. It is common to provide O-ring members 87 and 89 between the wear ring 130 and the tubular housing member 80.

Referring to the drawings of FIGS. 2A and B, there is illustrated a landing nipple for housing the safety valve emobidment illustrated in FIGS. 2A and 2B. The landing nipple useful with the safety valve of the present invention is provided with means for communicating control and balance pressure fluids, from a source at the surface of the well, into the nipple. The pressure fluids are conducted to the nipple by conduits (not shown) extending from the well surface. The landing nipple illustrated in FIGS. 2A and 2B is disclosed and claimed in copending application Ser. No. 960,169, filed Nov. 13, 1978 by John H. Yonker and the present applicant. The landing nipple, fully described and claimed therein, is incorporated herein by reference for the purpose of more fully understanding the operation of the safety valve of the invention.

What is claimed is:

1. A surface controlled subsurface safety valve comprising:

housing means for defining a flow path, closure means for controlling flow through said flow path, operator means longitudinally movable with respect to said housing means for moving said closure means and having a first position wherein said closure means closes said flow path and having a second position wherein said closure means opens said flow path, control fluid pressure responsive means for moving said operator means from said first position to said second position when affected by fluid pressurized above a selected value, balance fluid pressure responsive means for pressure balancing said operator means with respect to hydrostatic fluid pressure, resilient urging means for urging said operator means longitudinally within said housing means to move said closure means to its first position, a control fluid pressure chamber associated with said control fluid pressure responsive means for receiving control fluid, a variable capacity balance fluid pressure chamber associated with said balance fluid pressure responsive means for receiving balance fluid, a fixed capacity zone exposed to balance fluid pressure, means for providing a fluid seal between said control fluid pressure chamber and said variable capacity balance fluid pressure chamber and said fixed capacity zone exposed to balance fluid pressure, and means for directing well bore pressure only to said variable capacity balance fluid pressure chamber rather than to said control fluid pressure chamber.

2. The surface controlled subsurface safety valve of claim 1, wherein the seal effective area of the fixed capacity zone is essentially equal to the seal effective area of the control fluid pressure chamber.

3. The surface controlled subsurface safety valve of claim 1, wherein the housing means has a first port means for providing fluid communication between an external source of balance fluid and the variable capacity balance fluid pressure chamber, and second port means for providing fluid communication between said external source of balance fluid and the fixed capacity zone.

4. The surface controlled subsurface safety valve of claim 3, wherein said balance fluid entry ports for the balance fluid pressure chamber and balance fluid pressure zone have disposed on both sides thereof, on the housing means, seal means for engaging the bore walls of a safety valve receiving means in a tubing string whereby said seals separate said ports from well bore pressure when the subsurface safety valve is positioned in the receiving means made up in a tubing string.

5. The surface controlled subsurface safety valve of claim 4, wherein the housing means has means for providing fluid communication between an external source of control fluid and said control fluid pressure chamber, and wherein said control fluid communication means is separated from said first and second balance fluid ports by seal means on said housing means.

6. The surface controlled subsurface safety valve of claim 5, wherein said safety valve is adapted to be conducted through a well tubing string by wire line operations.

7. The surface controlled safety valve of claim 5, wherein said safety valve is adapted to be conducted through a well tubing string by pump down operations.

8. A surface controlled subsurface safety valve comprising:

housing means for defining a flow path, ball closure means for controlling flow through said flow path, operator means longitudinally movable within said housing means for moving said ball closure means and having a first position wherein said ball closure means closes said flow path and having a second position wherein said ball closure means opens said flow path, a piston, engaged with said operator means, responsive to control fluid pressure, for moving said operator means from said first position to said second position when affected by fluid pressurized above a selected value, seal means between said operator means and said housing means, to prevent well bore pressure from entering the space between said operator means and said housing means, an annular chamber between said housing means and said operator means, having disposed therein resilient urging means for urging said operator means from said second position to said first position when said control fluid pressure is less than said selected value, said annular chamber forming a variable capacity balance fluid pressure chamber at least one surface of which forms said balance fluid pressure responsive means for pressure balancing said operator means with respect to hydrostatic fluid pressure, a zone exposed only to balance fluid pressure, means for directing well bore pressure only to said variable capacity balance fluid pressure chamber in the event said seal means fails to prevent well bore pressure from entering the space between said operator means and said housing means.

9. The surface controlled subsurface safety valve of claim 8, wherein said safety valve is adapted to be conducted through a well bore by pump down operations.

10. The surface controlled subsurface safety valve of claim 8, wherein said safety valve is adapted to be conducted through a well bore by wire line operations.

* * * * *